US005995573A

United States Patent [19]

Murray, Jr.

[11] Patent Number: 5,995,573

[45] Date of Patent: Nov. 30, 1999

[54] DRY STORAGE ARRANGEMENT FOR SPENT NUCLEAR FUEL CONTAINERS

[76] Inventor: Holt A. Murray, Jr., 6 E. Prospect St., Hopewell, N.J. 08525

[21] Appl. No.: 08/933,176

[22] Filed: Sep. 18, 1997

Related U.S. Application Data

[60] Provisional application No. 60/026,261, Sep. 18, 1996.

[51] Int. Cl.[6] ..... G21C 19/00

[52] U.S. Cl. ..... 376/272; 250/507.1

[58] Field of Search ..... 376/272; 250/507.1; 588/16

[56] References Cited

U.S. PATENT DOCUMENTS

| | | |
|---|---|---|
| 1,986,303 | 1/1935 | Swift . |
| 1,990,168 | 2/1935 | Corson . |
| 2,027,750 | 1/1936 | Munson . |
| 2,275,188 | 3/1942 | Harrington . |

(List continued on next page.)

FOREIGN PATENT DOCUMENTS

| | | |
|---|---|---|
| 2235260 | 2/1991 | United Kingdom . |

OTHER PUBLICATIONS

T. Doering, D. Stahl, "High–Level Waste Package Retrievability", Proceedings of the Topical Meeting on Nuclear Waste Packaging, Focus '91, Proceedings of Radioactive Waste Management, Sep. 29, 1991, pp. 362–365.

D. Peters, K.J.A. Kundig, D.F. Medley, P.A. Enders, "Multi–Barrier, Copper–Base Containers for HLW Disposal", Proceedings of the Topical Meeting on Nuclear Waste Packaging, Focus '91, Proceedings of Radioactive Waste Management, Sep. 29, 1991, pp. 366–376.

K. Janberg, H. Spilker, R. Huggenberg, "The German Cask–Concept for Intermediate and Final Storage of Spent Fuel", Proceedings of the Topical Meeting on Nuclear Waste Packaging, Focus '91, Proceedings of Radioactive Waste Management, Sep. 29, 1991, pp. 385–394.

D.J. Harrison–Giesler, R.P. Morissette, "Summary of Yucca Mountain Engineered Barrier System Concepts Workshop", Proceddings of the Topical Meeting on Nuclear Waste Packaging, Focus '91, Proceedings of Radioactive Waste Management, Sep. 29, 1991, pp. 103–107.

R. Ellis, III, H. Murray, "Optimization of Toroidal Field Coil Conductor Properties for BPX", 1991 Fusion Engineering Proceedings, Oct. 1991, pp. 248–250.

H. Murray, I.D. Harris, J.O. Ratka, "Development of a Welding Procedure for High Conductivity, Copper–Beryllium Alloy C17510", 1991 Fusion Engineering Proceedings, Oct. 1991, pp. 272–275.

I.J.Zatz, H.A. Murray, "Fracture Testing of Berryllium Copper Alloy C17510", 1991 Fusion Engineering Proceedings, Oct. 1991, pp. 276–279.

H. Murray, "Characterization of Copper–Berryllium Alloy C17510", 1991 Fusion Engineering Proceedings, Oct. 1991, pp. 280–283.

(List continued on next page.)

*Primary Examiner*—Ngoclan T. Mai
*Attorney, Agent, or Firm*—Lerner, David, Littenberg, Krumholz & Mentlik, LLP

[57] ABSTRACT

A container for storing hazardous waste materials, particularly radioactive waste materials, includes a shell having a closed end and an open end, and a lid for closing the open end. A core assembly arranged in the shell divides the interior of the shell into a plurality of elongated compartments for receiving the waste materials. The shell may be formed from a plurality of identical segments welded to one another, each segment including plural compartments. Preferably, the shell, lid and core assembly are formed from a copper beryllium alloy. The containers may be positioned in a pair of parallel side-by-side rows to produce a self-shielding storage arrangement.

29 Claims, 6 Drawing Sheets

U.S. PATENT DOCUMENTS

| | | | |
|---|---|---|---|
| 2,325,041 | 7/1943 | Cooper . | |
| 2,376,593 | 5/1945 | Hellen . | |
| 2,758,367 | 8/1956 | Dougherty . | |
| 3,007,600 | 11/1961 | Horner . | |
| 3,031,568 | 4/1962 | Turner . | |
| 3,055,538 | 9/1962 | Schoessow . | |
| 3,144,035 | 8/1964 | Hablanian et al. . | |
| 3,175,087 | 3/1965 | Aupetit et al. . | |
| 3,181,722 | 5/1965 | Huston . | |
| 3,327,892 | 6/1967 | Lloyd et al. . | |
| 3,330,720 | 7/1967 | Stevens et al. . | |
| 3,406,863 | 10/1968 | Wenzel et al. . | |
| 3,432,666 | 3/1969 | Nash et al. . | |
| 3,615,281 | 10/1971 | Ramsden . | |
| 3,734,387 | 5/1973 | Sannipoli . | |
| 3,754,141 | 8/1973 | Leebl et al. . | |
| 3,770,964 | 11/1973 | Backus . | |
| 3,774,037 | 11/1973 | Backus . | |
| 3,817,540 | 6/1974 | Nicholson . | |
| 4,078,811 | 3/1978 | Bock et al. . | |
| 4,119,830 | 10/1978 | Gilliland . | |
| 4,179,314 | 12/1979 | Wikle . | |
| 4,187,410 | 2/1980 | Eroshkin et al. . | |
| 4,274,007 | 6/1981 | Baatz et al. . | |
| 4,278,892 | 7/1981 | Baatz et al. . | |
| 4,288,698 | 9/1981 | Baatz et al. . | |
| 4,295,031 | 10/1981 | Roen . | |
| 4,320,847 | 3/1982 | Gesser et al. . | |
| 4,326,642 | 4/1982 | Wolf . | |
| 4,336,441 | 6/1982 | Godai et al. . | |
| 4,355,224 | 10/1982 | Mesick et al. . | |
| 4,404,450 | 9/1983 | Weldon . | |
| 4,421,325 | 12/1983 | Napolitano . | |
| 4,445,042 | 4/1984 | Baatz et al. | 250/506.1 |
| 4,447,703 | 5/1984 | Stol . | |
| 4,460,659 | 7/1984 | Pederson et al. . | |
| 4,508,969 | 4/1985 | Janberg et al. . | |
| 4,527,065 | 7/1985 | Popp et al. | 250/506.1 |
| 4,535,250 | 8/1985 | Fields | 250/507.1 |
| 4,539,465 | 9/1985 | Bosna . | |
| 4,567,014 | 1/1986 | Popp et al. | 376/272 |
| 4,572,959 | 2/1986 | Popp et al. | 250/506.1 |
| 4,594,116 | 6/1986 | Inagaki . | |
| 4,594,214 | 6/1986 | Popp et al. | 376/272 |
| 4,596,688 | 6/1986 | Popp | 376/272 |
| 4,597,582 | 7/1986 | Muller . | |
| 4,635,896 | 1/1987 | Baker . | |
| 4,673,814 | 6/1987 | Schroeder et al. | 250/506.1 |
| 4,702,391 | 10/1987 | Koester et al. | 220/456 |
| 4,724,013 | 2/1988 | Church et al. . | |
| 4,724,302 | 2/1988 | Penney et al. . | |
| 4,738,388 | 4/1988 | Bienek et al. . | |
| 4,752,437 | 6/1988 | Ito et al. | 376/272 |
| 4,758,402 | 7/1988 | Schukei et al. | 376/205 |
| 4,818,878 | 4/1989 | Popp et al. | 250/507.1 |
| 4,847,009 | 7/1989 | Madle et al. | 252/633 |
| 4,872,563 | 10/1989 | Warden et al. . | |
| 4,881,678 | 11/1989 | Gaudin . | |
| 4,883,637 | 11/1989 | McDaniels, Jr. | 376/272 |
| 4,976,912 | 12/1990 | Madle et al. | 376/249 |
| 5,015,863 | 5/1991 | Takeshima et al. | 250/515.1 |
| 5,324,914 | 6/1994 | Murray, Jr. et al. | 219/137 WM |
| 5,391,887 | 2/1995 | Murray, Jr. | 250/506.1 |
| 5,615,794 | 4/1997 | Murray, Jr. | 220/304 |
| 5,715,289 | 2/1998 | Kirchner et al. | 376/272 |

OTHER PUBLICATIONS

H.A. Murray, I.J. Zatz, J.O. Ratka, "Fracture Testing and Performance of Berryllium Copper Alloy C17510", ASTM Standard Technical Publication 1184, vol. II, Apr. 1994, pp. 109–133.

H.A. Murray, I.J. Zatz, "Fracture Testing and Performance of Berryllium Copper Alloy C17510", Princeton University, Plasma Physics Laboratory Report 2983, May 1994, pp. 1–37.

H.A. Murray, "Concept for Hazardous Material Management and Container Closure Using Copper Based Alloys", 1994 High Level Radioactive Waste Management Proceedings, May 1994, pp. 1000–1007.

DRY STORAGE ARRANGEMENT FOR SPENT NUCLEAR FUEL CONTAINERS

CROSS-REFERENCE TO RELATED APPLICATIONS

This application claims the benefit of U.S. Provisional Application No. 60/026,261 filed Sep. 18, 1996, the disclosure of which is hereby incorporated by reference herein.

FIELD OF THE INVENTION

The present invention relates generally to hazardous waste management, and more particularly to the management of radioactive waste materials, such as spent nuclear fuels. Still more particularly, the present invention relates to a sealed, dry storage system for the long-term storage of radioactive and other hazardous waste materials.

BACKGROUND OF THE INVENTION

The management of hazardous waste materials, including radioactive, biological and chemical waste, is of critical concern to maintaining a safe environment. For chemical and biological wastes, the hazardous material initially may be contained in a vessel, and while in the vessel may be processed and rendered benign. Management of radioactive waste materials, however, raises special concerns since certain nuclear waste materials retain high levels of radioactivity for thousands of years. An initial concern in the management of these radioactive waste materials is the safe local containment of the materials as they are generated. Also of concern is the safe transport of the locally contained materials to specialized facilities for processing or for intermediate term or long-term storage. Thus, for example, high-level radioactive waste materials produced at nuclear utility sites are typically contained locally for a period of tens of years. Subsequently, plans call for these waste materials to be transported to a specialized facility for longer term storage and/or waste processing. In such intermediate term storage facilities, radioactive waste materials may be stored in containers for 40 to 100 years, with the containers being available for periodic integrity confirmation and the contents being accessible for retrieval and inspection. Subsequent to the intermediate storage period, the radioactive waste materials may be processed or transported to other specialized sites for long-term storage, for example, of from 300 to 1,000 years. One such long-term storage site is currently planned for the Tuff Repository in Nevada.

Presently, two arrangements for the short-term local storage of radioactive spent fuel rod assemblies predominate. Both arrangements have been designed to dissipate heat from the fuel rod assembles rapidly so as to prevent thermal breakdown of the assemblies as a result of overheating. In one arrangement, the spent nuclear fuel rod assemblies are stored exposed at the generation site in large pools of water. Elaborate systems are required not only to cool the water to a desired temperature, but also to chemically treat the water to provide radiation shielding between adjacent assemblies. In the other technique, the spent nuclear fuel rod assemblies are placed in racks surrounded by stainless steel containers which, in turn, are enclosed in concrete bunkers. Since stainless steel does not provide a sufficiently high thermal conductivity, a constant flow of air is forced through the containers to dissipate heat from the waste materials therein. This flow of air contacts the nuclear fuel rod assemblies directly and is then exhausted into the environment. Both of these arrangements require large storage areas, constant maintenance and rather elaborate systems to maintain the stability of the radioactive waste materials. Furthermore, where stainless steel containers are used, the containers are susceptible to swelling and corrosion, thereby jeopardizing the safety of the storage arrangement over long periods of time.

The growing inventories of spent nuclear fuels has resulted in an increasing urgency to develop containers and overall systems for the safe storage of these materials, both short term and long term. Despite the many efforts that have been made to address these concerns, there still exists a need for a simple, safe and economical system for containing and storing radioactive waste materials for prolonged periods of time. Preferably, such system will enable the waste materials to be accessed periodically for inspection and/or processing.

SUMMARY OF THE INVENTION

The present invention addresses these needs.

One aspect of the present invention provides a container for storing hazardous materials. The container includes a shell having a closed end, an open end and an interior cavity extending in a longitudinal direction between the closed end and the open end. A core assembly arranged in the shell includes a plurality of wall members extending in the longitudinal direction to divide the interior cavity of the shell into a plurality of elongated compartments having a length between the closed end of the shell and the open end. A lid connectable to the shell may be provided to close the open end.

The core assembly may include a multiplicity of segments connected to one another, each segment including plural ones of the compartments. Each segment may include an outer surface shaped for mating engagement with an interior surface of the shell, a pair of elongated peripheral edges disposed on opposite ends of the outer surface, and an elongated internal edge spaced from the outer surface, the segments being connected to one another at least along the pair of peripheral edges. In highly preferred embodiments, the segments may be identical to one another.

In one preferred embodiment hereof, the shell may include a plurality of ribs extending in the longitudinal direction in the interior cavity. Each one of the ribs may define a hollow elongated channel in the interior cavity of the shell, which hollow channel may be filled with a material selected from the group consisting of materials having high thermal conductivity properties, materials having high nuclear radiation shielding properties, and mixtures thereof. Alternatively, the ribs may be formed as solid structures. In a highly preferred embodiment, the ribs may be formed as solid structures by coextrusion with the shell.

In another embodiment, the container may further include at least one pair of spacers sized and shaped for insertion into the opposed ends of one compartment of the core assembly to reduce the length of the compartment. In accordance with this embodiment, the spacers may be connected to a pair of end plates provided to close the open ends of the core assembly compartments. Preferably, each one of the spacers has a cross-section which is about the same as the cross-section of the compartment so that the pair of spacers fit snugly within the compartment's opposed ends.

In yet another embodiment hereof, the container may further include a sealing element for providing a mechanical seal between the lid and the shell. The sealing element may be positioned between a shoulder in the interior cavity of the shell at a spaced distanced from the open end thereof and a bottom surface of the lid when the lid is connected to the shell. The sealing element preferably may be formed as a metallic disk.

In a still further embodiment hereof, the container may include a shielding insert positioned to line selected walls in each one of the plurality of compartments. Preferably, the selected walls are those walls separating one compartment from an adjacent compartment. Preferred materials for forming the shielding inserts of this embodiment include hafnium, borated aluminum, borated alloys including copper, borated stainless steels and mixtures thereof.

The storage containers of the present invention provide for the sealed, dry storage of hazardous materials, including spent nuclear fuel rod assemblies. Moreover, the containers minimize the equilibrium temperature of the fuel rod assemblies by providing an efficient path for heat flow from the fuel rod assemblies to the environment, all while maintaining the fuel rod assemblies under isolated conditions. This lower equilibrium temperature translates into enhanced long term structural integrity for both the spent fuel rod assemblies and the shielding inserts. As a further benefit, by filling as much of the free space within its interior as possible, the container inhibits the infiltration of materials which may trigger corrosion processes.

The containers of the present invention keep the fuel rod assemblies isolated from one another and enable them to be stored in the preferred horizontal orientation. Thus, in the event the fuel rod assemblies should disintegrate as a result of deterioration over time, the horizontal orientation and internal compartmented structure will maintain the radioactive materials in a substantially uniform distribution throughout the container. As a result, mounds of radioactive material do not accumulate at the bottom of the container as a result of vertical storage, or along the side of the container as a result of non-compartmented horizontal storage.

Another aspect of the present invention provides methods for storing hazardous materials. A method in accordance with one embodiment of this aspect of the invention may include the step of providing a plurality of storage containers, each storage container including a shell having a longitudinal axis, first and second ends, and an interior cavity extending along the longitudinal axis between the first and second ends, and a core assembly arranged in the shell, the core assembly including a plurality of wall members extending substantially parallel to the longitudinal axis to divide the interior cavity of the shell into a plurality of elongated compartments having a length between the first end of the shell and the second end. The storage containers may be arranged substantially parallel with one another in a pair of rows extending in an alignment direction, each one of the storage containers in a row being spaced from an adjacent one of the storage containers in the row and being oriented with its longitudinal axis projecting in an orientation direction substantially perpendicular to the alignment direction. Each storage container in one row may be aligned coaxially with an adjacent storage container in the other row with the second end of the shell of each storage container in the one row confronting the second end of the shell of the storage container aligned coaxially therewith.

In accordance with another embodiment hereof, the method may further include the step of providing a second plurality of storage containers and arranging the second plurality of storage containers substantially parallel with one another in a second pair of rows on top of the first pair of rows, each storage container in the second pair of rows being positioned in an interstice formed between adjacent storage containers in the first pair of rows so that each storage container in one of the second pair of rows is aligned coaxially with an adjacent storage container in the other one of the second pair of rows with the second end of the shell of each storage container in one row confronting the second end of the shell of the storage container aligned coaxially therewith.

A still further aspect of the present invention provides a method for designing a container for storing hazardous materials. A method in accordance with this aspect of the invention may include the steps of selecting a material for forming the container, the material having a certain yield strength. The container may then be configured to have a peak stress under operating conditions between about five percent and about fifteen percent of the yield strength. Preferably, the container is configured to have a peak stress under operating conditions of about ten percent of the yield strength.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION OF THE PREFERRED EMBODIMENTS

Figure 1:
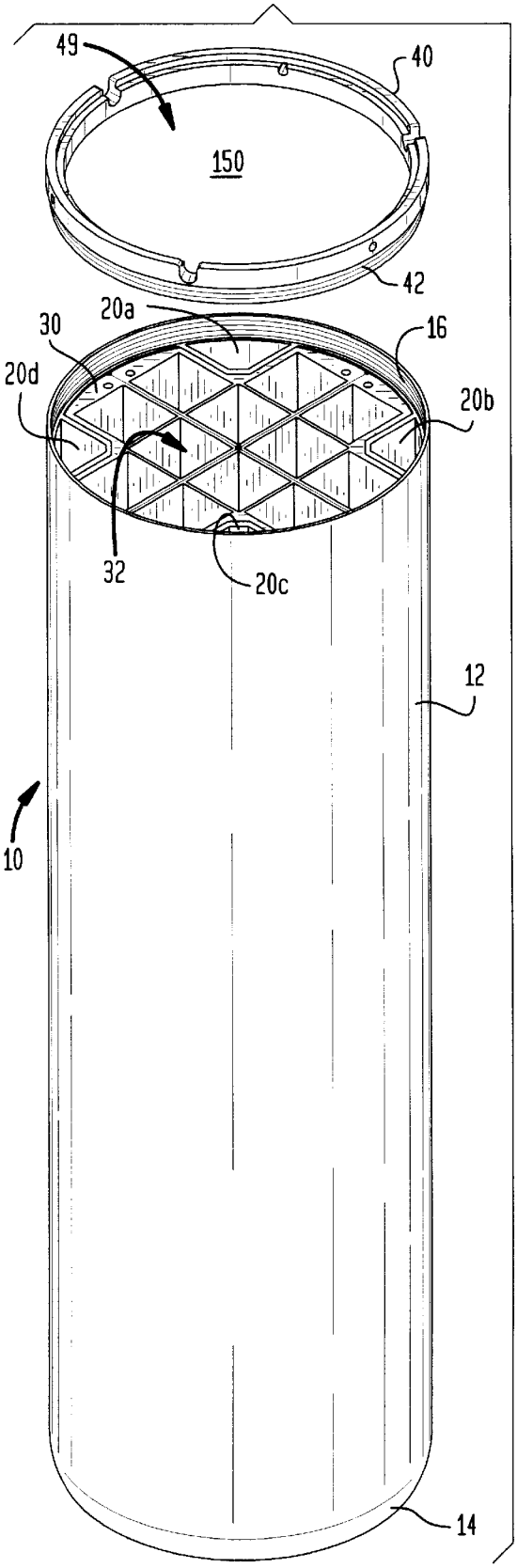
FIG. 1 is a perspective view of a storage container in accordance with the present invention, with the lid disassembled therefrom to show the interior thereof.
Figure 2:
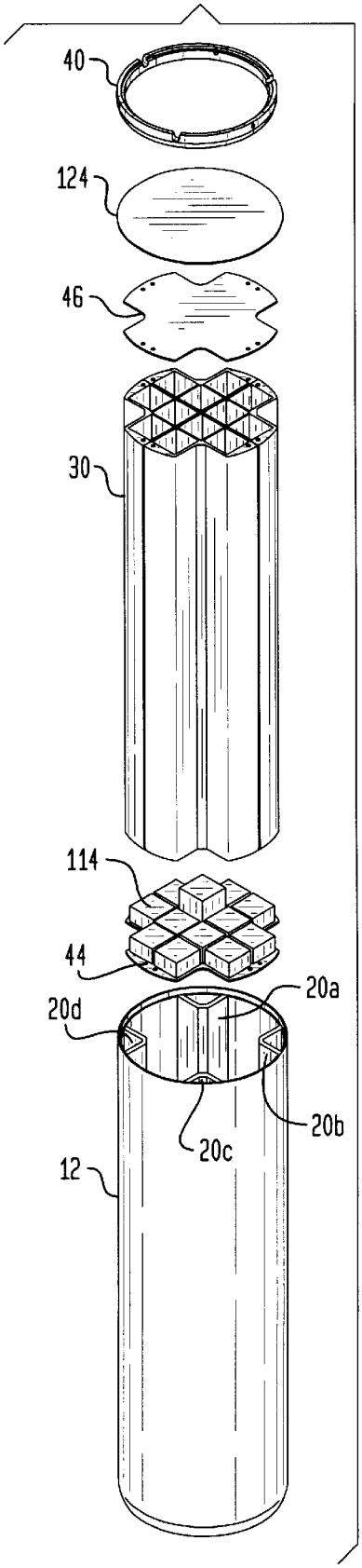
FIG. 2 is an exploded perspective view of the storage container of FIG. 1.

Referring to FIGS. 1–2, there is illustrated a preferred embodiment of a storage container 10 in accordance with the present invention. Desirably, container 10 provides for storage of hazardous waste materials, including biological, chemical and radioactive waste materials. Container 10 generally includes an elongated outer shell 12 having a closed end 14 and a threaded open end 16, an internal core assembly 30 arranged in the shell, and a lid 40 for closing open end 16.

Detailed descriptions of the structure and composition of shell 12 and lid 40 may be found in U.S. Pat. Nos. 5,391,887 and 5,615,794, the disclosures of which are hereby incorporated by reference herein. Briefly, shell 12 may have a generally cylindrical cross-section as illustrated in the figures, although any other cross-sectional shape is contemplated herein, including square, rectangular, hexagonal, elliptical, etc. Closed end 14 may be formed integrally with the walls of shell 12, as by well-known back extrusion or casting techniques. The lid 40 may have a smaller diameter threaded portion 42 for engagement with the threaded open end 16 of shell 12. Preferred materials for fabricating shell 12 and lid 40 are precipitation hardenable alloys which exhibit superior thermal conductivity, a high yield strength, mechanical stability and cyclic fatigue capability, homogeneous properties, high fracture toughness, significant impact strength, and dimensional stability even under extreme radiation dosage. A highly preferred material in this regard is copper beryllium. When assembled, lid 40 and the open end 16 of shell 12 together may define a U-shaped channel 18 (FIG. 7) for use in welding lid 40 in fixed relationship to shell 12, as discussed further below. A more detailed description of the techniques for welding lid 40 to shell 12 may be found in the aforementioned U.S. Pat. Nos. 5,391,887 and 5,615,794, as well as in U.S. Pat. No. 5,324,914, the disclosure of which is hereby incorporated by reference herein.

In its interior, shell 12 may include a series of ribs or rails, such as the four equally spaced rails 20*a*, 20*b*, 20*c* and 20*d* illustrated in FIGS. 1 and 2. Rails 20*a–d* may be formed from a plate material and joined to the inner surface of shell 12 by welding or another technique which provides a superior mechanical and thermal connection therebetween. In their assembled positions, rails 20*a–d* having this construction form hollow structures, as illustrated, the interiors of which may be filled with materials having a high thermal capacity, materials providing good radiation shielding, or mixtures of these two types of materials. Materials of these types are well known to those skilled in the art. Alternatively, rails 20*a–d* may be formed as solid structures, as by coextrusion or casting integral with the remainder of shell 12. Preferably, the rails extend from the closed end 14 of shell 12 to the open end 16 thereof, and are formed from the same copper beryllium or other precipitation hardenable alloy used to form the shell. Rails 20*a–d* serve several functions, including, among others, to structurally reinforce shell 12 with respect to both static and impact loading; to align and guide inner core assembly 30 for insertion into the shell; to support inner core assembly 30 in its assembled position in shell 12; to fill the volume of shell 12 to hinder the infiltration of liquids and gases; to provide further radiation shielding for the nuclear waste materials stored in container 10; and as an enhanced heat conduction path. It will be appreciated that any number of rails other than four may be used, provided they serve all or most of the functions noted above.

Internal core assembly 30 divides the interior of shell 12 into a plurality of individual tubular compartments 32 which extend substantially the entire length of the shell. Since the majority of nuclear fuel rod assemblies in use today are pressurized water reactor (PWR) assemblies having a substantially square cross-section, core assembly 30 is described herein as defining compartments 32 which have a substantially square cross-section. However, the present invention contemplates the use of core assemblies 30 defining compartments 32 which have different cross-sectional shapes, including rectangular, round, elliptical, etc., designed to correspond to the shape of the fuel rod assemblies or other hazardous waste materials to be contained therein. A pair of end plates 44 and 46 may be provided for closing the open ends of compartments 32, as described in more detail below.

Core assembly 30 may be formed by joining together four identical segments 50, each of which defines three compartments 32*a*, 32*b* and 32*c* arranged generally in an L shape so that, when segments 50 are joined together, core assembly 30 includes twelve elongated compartments 32 arranged in the shape of a "+" symbol. Compartments 32 need not be of the same cross-sectional size. Indeed, as explained below, compartments 32*a* and 32*c* in preferred segments 50 may be of about the same cross-sectional size, and compartment 32*b* may be slightly larger in cross-section. Segments 50 may be formed readily and economically using extrusion techniques, preferably from the same copper beryllium or other precipitation hardenable alloy as is used to form the other major components of container 10.

Figure 3:
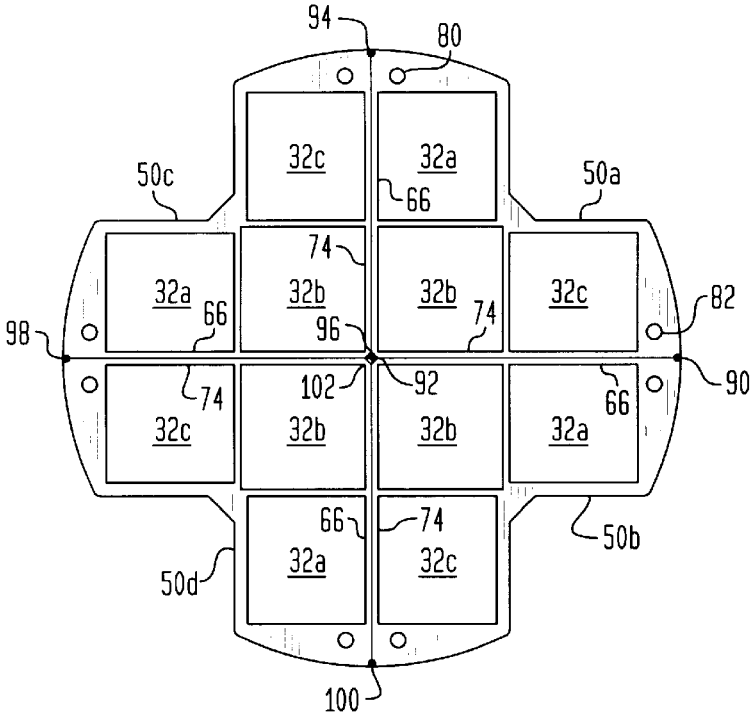
FIG. 3 is a top plan view of the internal core assembly of the present invention.
Figure 5:
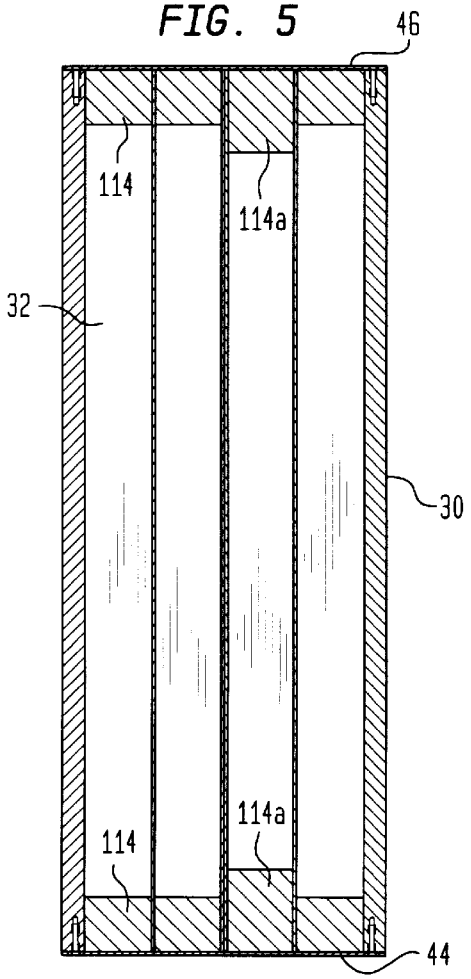
FIG. 5 is a cross-sectional view taken through the longitudinal center of the internal core assembly.
Figure 4:
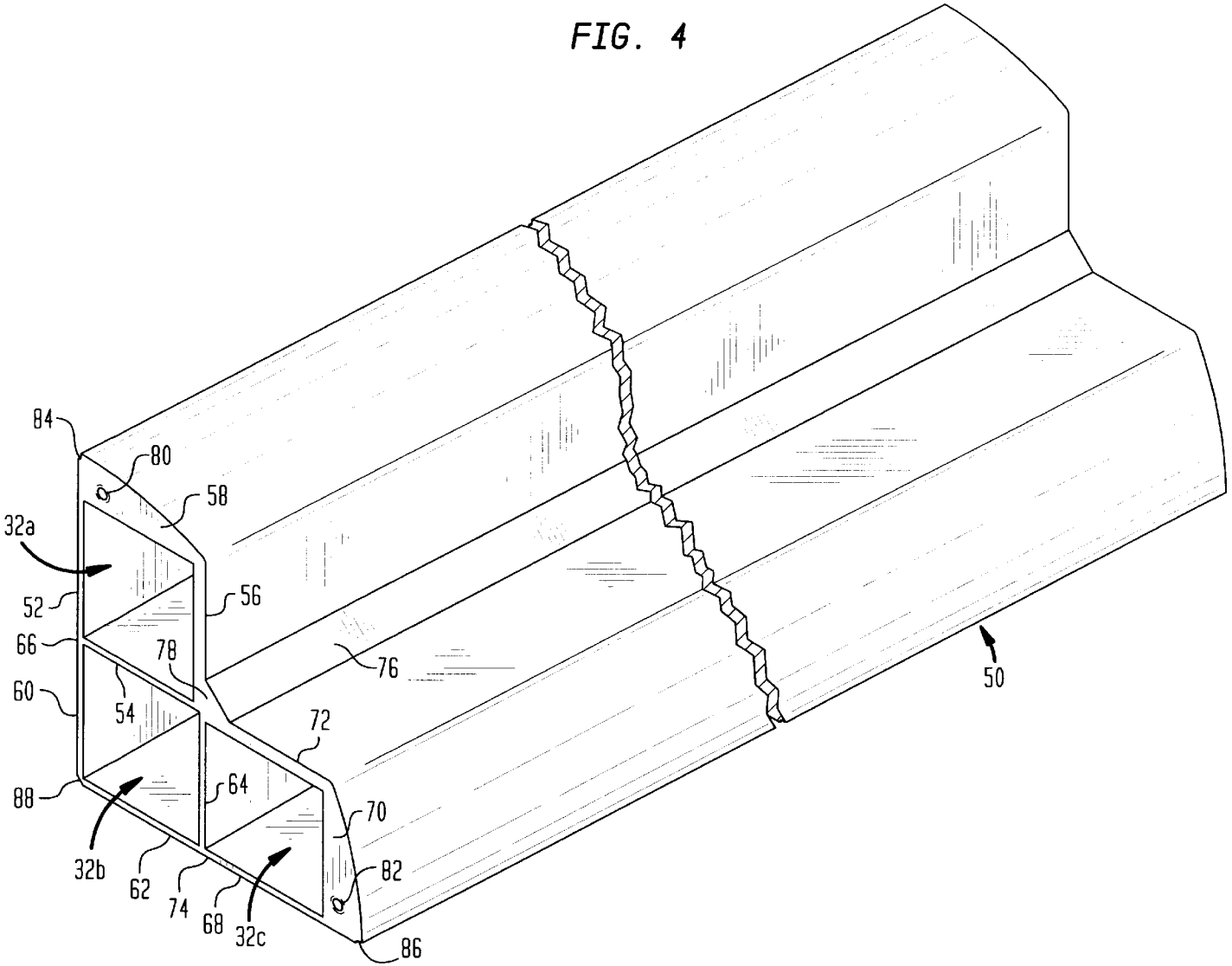
FIG. 4 is a perspective view of one segment forming the internal core assembly of FIG. 3.

Referring to FIGS. 3 and 4, compartment 32*a* has a generally square cross-section defined by walls 52, 54, 56 and 58. Walls 52 and 54 may have substantially the same uniform thickness. Wall 56 also may have a substantially uniform thickness which may be greater than the thicknesses of walls 52 and 54. Wall 58 has a substantially flat inner surface and an outer surface which is curved so as to define a wall thickness which decreases from wall 52 toward wall 56. Preferably, the outer surface of wall 58 has a radius of curvature which is substantially similar to the radius of curvature of the inner surface of shell 12 so as to conformingly mate therewith.

Compartment 32*b* has a generally square cross-section defined by walls 54, 60, 62 and 64. Wall 60 is substantially coplanar with wall 52, the two walls together defining outer wall 66 of segment 50. Walls 60, 62 and 64 may have substantially uniform thicknesses which are about the same as the thicknesses of walls 52 and 54.

Finally, compartment 32*c* has a generally square cross-section defined by walls 64, 68, 70 and 72. Wall 68 may have a substantially uniform thickness which is about the same as the thicknesses of walls 52, 54, 60, 62 and 64. Further, wall 68 is substantially coplanar with wall 62, the two walls together defining outer wall 74 of segment 50. Wall 72 also may have a substantially uniform thickness which may be greater than the thicknesses of walls 64 and 68. Wall 70 has a substantially flat inner surface and an outer surface which is curved so as to define a thickness which decreases from wall 68 toward wall 72. Here again, the outer surface of wall segment 70 preferably has a radius of curvature which is substantially similar to the radius of curvature of the inner surface of shell 12 so as to conformingly mate therewith.

An intermediate wall 76 may be joined diagonally between walls 56 and 72 at their point of intersection so as to define a region 78 of increased mass which increases the overall strength, thermal conductivity and heat capacity of segment 50. The added mass in region 78 also facilitates the manufacture of segment 50, particularly where segment 50 is manufactured by an extrusion or casting process. Threaded holes 80 and 82 may be provided at each end of walls 58 and 70, respectively, for attaching end plates 44 and 46 to the opposite ends of core assembly 30, as described hereinafter.

Each segment 50 may include a pair of curved recesses 84 and 86 extending along the entire length of the segment, one recess 84 located at an outside edge of segment 50 at the intersection of outer wall 66 and wall 58, and the other recess 86 located at an outside edge of segment 50 at the intersection of outer wall 74 and wall 70. Segment 50 may also have a curved recess 88 extending along its entire length at the intersection of outer walls 66 and 74. Recesses 84, 86 and 88 serve as weld sites for joining segments 50 to one another.

Thus, referring to FIG. 3, two segments 50*a* and 50*b* may be positioned adjacent one another so that the outer wall 74 of segment 50*a* is aligned in contact with the outer wall 66 of segment 50*b*. Segments 50*a* and 50*b* may be aligned with one another and temporarily held in place by bolting the segments to end plates 44 and 46. Once so positioned, recess 86 in segment 50*a* will be aligned with recess 84 in segment 50*b* to define a U-shaped weld channel 90. Similarly, the recesses 88 on segments 50*a* and 50*b* will be aligned one another to define a U-shaped weld channel 92. Segments 50*a* and 50*b* may then be permanently joined together by welding along weld channels 90 and 92, preferably using the techniques described in U.S. Pat. No. 5,324,914 for welding together precipitation hardenable materials. In accordance with such techniques, welding is accomplished after several passes to fill each weld channel, using a weld filler material having a composition such that its precipitation hardening temperature is lower than the age hardening temperature threshold of the materials being joined.

Positioning the weldments at opposite ends of the interface between walls 66 and 74 produces more than sufficient mechanical strength without interfering with the thermal properties of core assembly 30. Thus, considerable mechanical strength is developed by welding segments 50 together along their entire lengths. Furthermore, the weldments in these positions do not interrupt the thermal path as heat flows from the nuclear fuel rod assemblies outwardly to shell 12 and then to the environment. In that regard, because of the overall uniform distribution of heat in core assembly 30, the heat flow from the nuclear fuel rod assemblies travels outwardly in radial directions to shell 12. Hence, the thermal path from even those fuel rod assemblies in the innermost compartment 32*b* does not cross the interface between adjacent segments 50, but rather would travel from these innermost compartments radially outward along outer walls 66 and 74. In addition, the geometry of core assembly 30 as described above, including the location and orientation of the weldments, minimizes the thermally-sourced stresses exerted on the weldments.

Following the joining of segments 50*a* and 50*b*, the weldment in channel 92 may be machined if needed to assure that no portion thereof protrudes beyond the plane defined by outer wall 66 of segment 50*a* and outer wall 74 of segment 50*b*. Subsequently, segment 50*c* may be positioned adjacent segment 50*a* so that outer wall 74 thereof is aligned in contact with outer wall 66 of segment 50*a*. Again, end plates 44 and 46 may be used to temporarily hold segment 50*c* in its assembled position. Segments 50*a* and 50*c* may then be joined permanently together in the same manner as described above in connection with segments 50*a* and 50*b*, i.e., by welding along weld channels 94 and 96 at the opposite edges of these segments.

Finally, segment 50*d* may be positioned in the remaining quadrant and joined to the assembly by welding along perimeter weld channels 98 and 100. Because the center of the assembly is no longer accessible with segment 50*d* in its assembled position, no weld can be made in this region to join segment 50*d* along its recess 88 to the other segments. Hence, a gap 102 is formed adjacent the recess 88 of segment 50*d* along the entire length of core assembly 30. Since the heat flow from core assembly 30 is in radially outward directions, gap 102 has little or no impact on the mechanical or thermal characteristics of the core assembly.

Once all of segments 50*a–d* have been assembled together, the welds along perimeter channels 90, 94, 98 and 100 may be machined to conform to the radius of curvature of the outer surface of core assembly 30 so as to not interfere with the insertion of the core assembly into shell 12. The entirety of core assembly 30 may then be subjected to a heat treatment in order to obtain in the weld filler and heat affected zones thermal and mechanical characteristics approaching those of the parent material being joined together.

As noted above, end plate 44 may be assembled by bolting to the threaded holes 80 and 82 located around the periphery of core assembly 30 at one end thereof. End plate 46 may be assembled by bolting to the opposite end of core assembly 30 in a similar fashion. In order to adjust the length of compartments 32 to accommodate nuclear fuel rod assemblies of different lengths, end plates 44 and 46 may be provided with spacers 114 which are sized and shaped to project into compartments 32. Preferably, the spacers 114 at the opposite ends of any one compartment will be of the same length so that the nuclear fuel rod assembly will be positioned longitudinally in the center of the compartment. The spacers 114 in one compartment, however, need not be the same length as the spacers in other compartments. Thus, spacers of greater length, such as spacers 114*a*, may be used to tailor core assembly 30 to have one or more compartments which are shorter in length than the others. The use of these spacers allows a standard core assembly 30 to be customized with minimum effort, no change in the integrity of the system and no change in the longitudinal center of gravity of the assembly.

Spacers 114 preferably are formed from a material which is chemically and thermally compatible with the material forming core assembly 30, such as, for example, copper beryllium. However, when enhanced radiation shielding is desired, spacers 114 may include a more effective radiation shielding material, such as, for example, depleted uranium. Spacers 114 may be formed entirely from this more effective radiation shielding material, from a mixture of this material and another material, such as copper beryllium, or as a laminated structure including one or more layers of this material and another material. Any other arrangements for incorporating a highly effective radiation shielding material into spacers 114 are contemplated herein.

Figure 6:
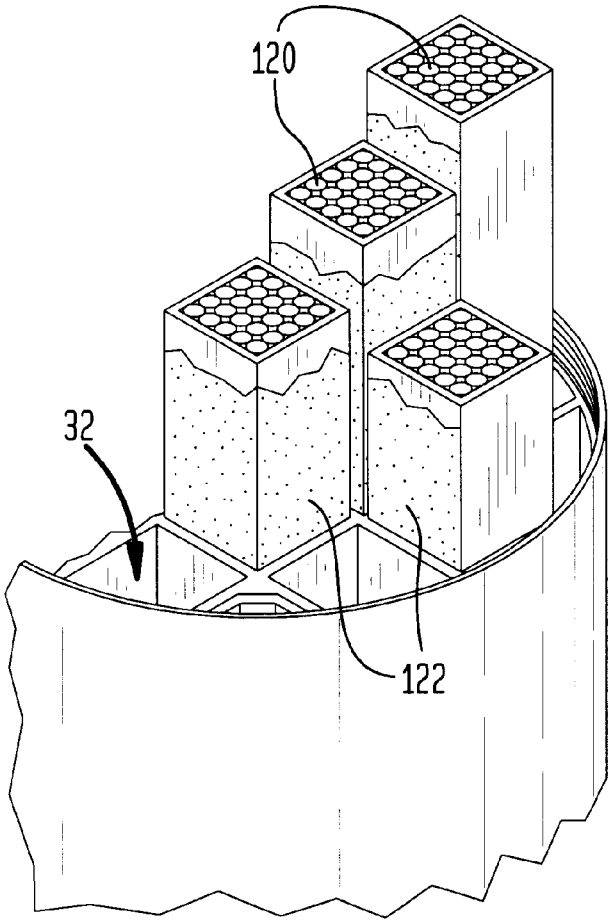
FIG. 6 is an enlarged partial schematic view showing the arrangement of the fuel rod assemblies and shielding inserts in the internal core assembly.

Once the various component parts of container 10 have been fabricated, the spent nuclear fuel rod assemblies or other hazardous waste materials may be inserted therein for storage. As a first step, end plate 44 may be assembled to one end of core assembly 30, with spacers 114 of appropriate length assembled to end plate 44 to adjust the lengths of compartments 32 as desired. Fuel rod assemblies 120 may then be inserted into each of compartments 32. In order to attenuate the nuclear radiation communication between adjacent compartments 32, each compartment may be provided with a shielding insert 122 lining those walls of the compartment which are adjacent another compartment. For example, referring to FIGS. 4 and 6, each compartment 32*a* would have a shielding insert 122 lining walls 52 and 54 thereof. Similarly, each compartment 32*c* would have a shielding insert 122 lining the walls 64 and 68 thereof. Compartments 32*b*, on the other hand, would have a shielding insert 122 lining each of its walls 54, 60, 62 and 64. To accommodate the additional amount of shielding insert 122 therein, compartments 32*b* preferably have a cross-section which is slightly larger than the cross-section of compartments 32*a* and 32*c*, as noted above. Shielding inserts 122 are in sheet form, and preferably are formed from materials having good radiation attenuation properties, good thermal conductivity, resistance to corrosion, and chemical compatibility with the spent fuel rod assemblies and the materials forming core assembly 30. Preferred materials in this regard are hafnium and metals and alloys incorporating boron, including borated aluminum, borated alloys including copper, and borated stainless steels. In a preferred arrangement, shielding inserts 122 may be wrapped in a continuous sheet around the appropriate sides of nuclear fuel rod assemblies 120 so that as the fuel rod assemblies are inserted into their respective compartments 32, shielding inserts 122 will overlie the appropriate walls of the compartments. With all of the fuel rod assemblies in place, end plate 46, with the appropriate spacers 114 thereon, may be bolted to core assembly 30 to close the open end thereof.

The enclosed core assembly 30 may then be inserted into shell 12 by aligning the outer curved surfaces of the core assembly between adjacent rails 20 and sliding the core assembly in place. Prior to closing the open end 16 of shell 12 with lid 40, a metal disk 124 preferably is inserted into shell 12 to provide a metal-to-metal mechanical seal between a shoulder 126 formed immediately below the threaded portion at the open end 16 of shell 12, and the bottom surface 48 of lid 40 as the lid is threaded tightly onto the shell. Various embodiments for achieving this metal-to-metal seal are described in detail in the aforementioned U.S. Pat. No. 5,391,887. Once lid 40 has been tightened in place on shell 12, the components may be sealed to one another by welding in a number of passes to form a single weld bead 130 around the circumference of container 10, as described in U.S. Pat. No. 5,324,914. After welding has been completed, the weld filler and heat affected zone may be heat treated to achieve the desired mechanical and thermal properties therein. Subsequently, weld bead 130 may be ground flush with the outer circumference of container 10. Alternatively, weld bead 130 may be ground prior to the heat treatment step.

Figure 7:
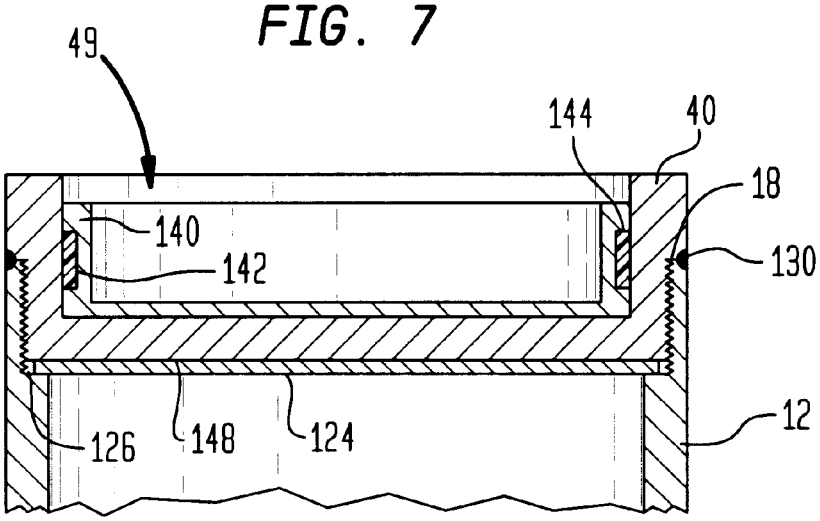
FIG. 7 is a partial cross-sectional view of the container of the present invention showing an arrangement for x-ray inspection of the weld securing the lid in place.

One arrangement for inspecting the integrity of weld bead 130 is illustrated in FIG. 7. In accordance with this arrangement, a cup-like insert 140 may be dimensioned to frictionally fit in an indexed position within the recess 49 in lid 40. A shallow channel 142 is formed in a circumferential band around the outside surface of insert 140. Channel 142 retains x-ray film 144 directly behind circumferential weld bead 130. X-rays may then be directed through weld bead 130 to expose film 144, providing both an indication of the condition of weld bead 130 and a permanent record of each inspection made thereof for the purpose of comparison with films produced during previous or subsequent inspections.

In accordance with the present invention, containers 10 may be produced which, during normal operation, are subjected to a peak stress which is far below conventional low stress design criteria. As used herein, the term "low stress design" means that the highest or peak stress to which the design of the container will be subjected during normal operating conditions will be less than one-third of the yield strength of the material from which the container is fabricated. When the containers of the present invention are formed from precipitation hardenable materials having high yield strengths, such as copper beryllium, however, the design features described above yield peak stresses under normal operating conditions which are between about five percent and about fifteen percent of the yield strength of such materials, and preferably about 10 percent of such yield strength. Containers configured in accordance with the present invention typically experience a peak stress during normal operation on the order of about 10 ksi. Copper beryllium alloys have a yield strength on the order of about 100 ksi. Therefore, these containers exhibit a peak stress during normal operation of about 10% of the yield strength of the materials from which they are fabricated, well below conventional low stress design levels.

Once weld bead 130 has been inspected and its integrity assured, insert 140 may be removed from recess 49 in lid 40 and a plug 150 of radiation shielding material may be inserted in its place. Although any well-known radiation shielding material may be used to form plug 150, a particularly preferred material for this purpose is depleted uranium. Plug 150 may be formed as a separate element and then joined by press fit into recess 49. In another arrangement, plug 150 may be formed by casting the desired material directly into recess 49.

Figure 8:
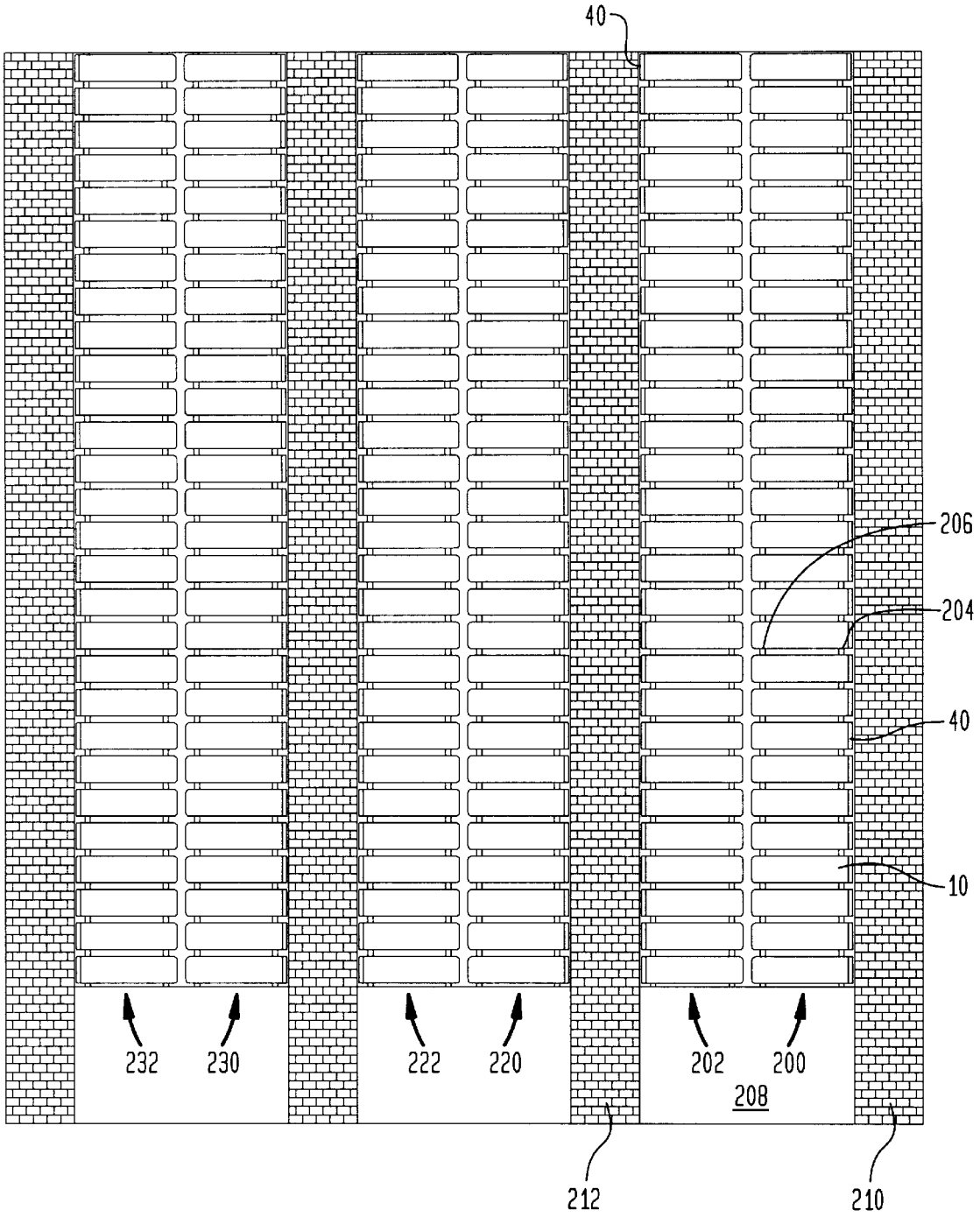
FIG. 8 is a highly schematic top plan view showing one arrangement for long-term storage of the containers of the present invention.

The containers 10 in accordance with the present invention are particularly suitable for use in one or more self-shielding dry storage arrangements. One embodiment of such dry storage arrangement is illustrated in FIG. 8. In accordance with this embodiment, a plurality of containers 10 are arranged substantially parallel to one another in a single layer in a pair of adjacent rows 200 and 202. A pair of spacers 204 and 206 separate each container 10 in a row by a fixed distance from the next adjacent container in that row. The containers 10 in row 200 are positioned in back-to-back relation with containers 10 in row 202. Thus, all of the containers 10 in row 200 are oriented with their lids 40 adjacent access aisle 210, and all of the containers 10 in row 202 are oriented with their lids 40 adjacent access aisle 212. Furthermore, each container 10 in row 200 is aligned coaxially with the adjacent container 10 in row 202. A large mass 208 formed, for example, from concrete, may be positioned at one end of rows 200 and 202 to provide shielding at the end of the rows to prevent access to the containers from the end of the rows, and to provide a place for individual staging, inspection and measurement of the containers in rows 200 and 202.

Where the number of containers to be stored exceeds the capacity of a single pair of rows 200, 202, the storage facility may include additional pairs of rows 220, 222 and 230, 232 arranged in a similar fashion, as illustrated, to accommodate these additional containers. The arrangement in FIG. 8 is therefore merely exemplary, illustrating how containers 10 may be arranged to store 168 containers (and therefore 2016 fuel rod assemblies) in a self-shielding and accessible fashion in a room 133 feet wide and 152 feet long, for an average storage space of 10 $ft^2$ for each fuel rod assembly. It will be appreciated that additional and/or longer pairs of rows may be employed where additional storage capacity is needed.

The storage arrangement described above is self-shielding in that, regardless of where an inspector may stand in access aisles 210 or 212, the radiation emanating from any point within a single container 10 would necessarily have to pass through and would thus be attenuated by the radiation shielding plug 150 in the end of at least one container and, perhaps, the shell 12 and core assembly 30 of at least one container, including the shielding inserts 122 therein. Because of the radiation shielding properties of the materials forming the shells 12, core assemblies 30, shielding inserts 122 and plugs 150, the radiation emanating from the containers will be attenuated to acceptable levels prior to reaching an aisle.

The foregoing storage arrangement provides sufficient space between containers 10 so that the containers may cool naturally without the need for specialized cooling apparatus, venting, or direct contact of a cooling medium with the spent fuel rod assemblies. Moreover, the storage arrangement permits easy access to each storage container so that individual containers may be removed easily for inspection and/or measurement by conventional automated equipment, without the need to lift any storage container over another.

Figure 9:
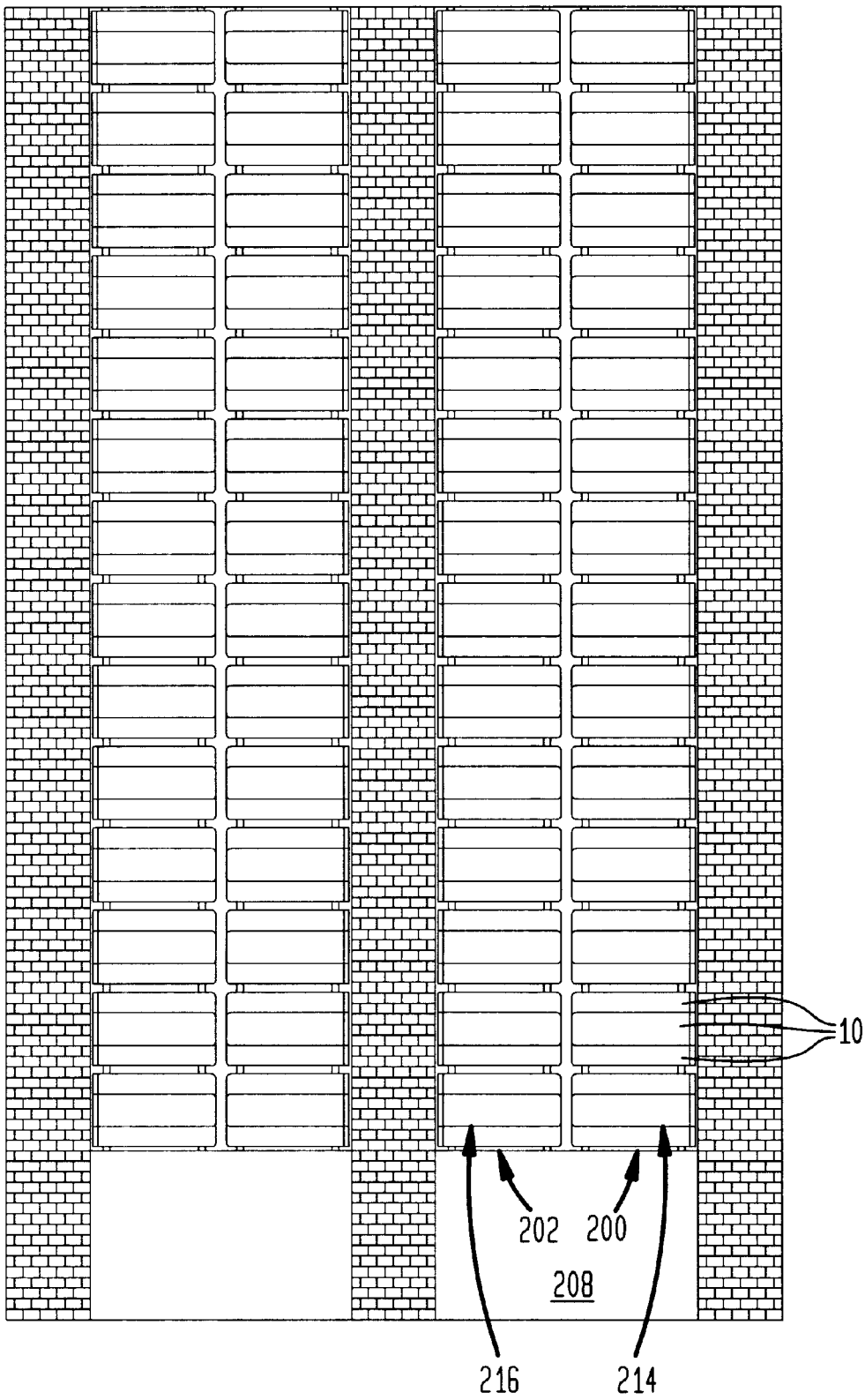
FIG. 9 is a highly schematic top plan view showing an alternate arrangement for the long-term storage of the containers of the present invention.

Another embodiment of a storage arrangement in accordance with the present invention is illustrated in FIG. 9. This arrangement provides for more compact storage by positioning a second layer of containers 10 in the interstices formed between each separate pair of containers in a row. That is, a second layer 214 of containers 10 may be positioned in row 200 above the containers in the first layer, and a second layer 216 of containers 10 may be positioned in row 202 above the containers in the first layer. Again, longer or additional rows of containers may be provided as needed. Thus, FIG. 9 merely illustrates an example of how the same 2016 fuel rod assemblies of FIG. 8 may be stored more compactly within a room 55 ft wide and 153 ft long, for an average storage space of 4.2 $ft^2$ for each fuel rod assembly.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as set forth in the appended claims. For example, the core assembly may include more or less than twelve compartments depending on the size and shape of the fuel rod assemblies or other hazardous materials to be contained therein, as well as other design considerations.

I claim:

1. A container for storing hazardous materials, comprising a shell having a closed end, an open end, and an interior cavity extending in a longitudinal direction between said closed end and said open end;

a core assembly arranged in said shell, said core assembly including a plurality of wall members extending in said longitudinal direction to divide said interior cavity of said shell into a plurality of elongated compartments having a length between said closed end of said shell and said open end; and a lid connectable to said shell for closing said open end, said shell, said lid and said core assembly being formed from a precipitation hardenable material.

2. The container as claimed in claim 1, wherein said precipitation hardenable material comprises a copper beryllium alloy.

3. A container for storing hazardous materials, comprising a shell having a closed end, an open end, and an interior cavity extending in a longitudinal direction between said closed end and said open end, said shell being formed from an extrusion process;

a core assembly arranged said shell, said core assembly including a plurality of wall members extending in said longitudinal direction to divide said interior cavity of said shell into a plurality of elongated compartments having a length between said closed end of said shell and said open end; and a lid connectable to said shell for closing said open end.

4. A container for storing hazardous materials, comprising a shell having a closed end, an open end, an interior cavity extending in a longitudinal direction between said closed end and said open end, and a plurality of ribs extending in said longitudinal direction in said interior cavity;

a core assembly arranged in said shell, said core assembly including a plurality of wall members extending in said longitudinal direction to divide said interior cavity of said shell into a plurality of elongated compartments having a length between said closed end of said shell and said open end; and a lid connectable to said shell for closing said open end.

5. The container as claimed in claim 4, wherein each one of said plurality of ribs defines a hollow elongated channel in said interior cavity of said shell.

6. The container as claimed in claim 5, wherein said hollow elongated channels are filled with a material selected from the group consisting of materials having high thermal conductivity properties, materials having high nuclear radiation shielding properties, and mixtures thereof.

7. The container as claimed in claim 4, wherein said plurality of ribs are solid.

8. The container as claimed in claim 7, wherein said shell is formed from an extrusion process, and said plurality of ribs are formed by coextrusion with said shell.

9. A container for storing hazardous materials, comprising a shell having a closed end, an open end, and an interior cavity extending in a longitudinal direction between said closed end and said open end;

a core assembly arranged in said shell, said core assembly including a plurality of wall members extending in said longitudinal direction to divide said interior cavity of said shell into a plurality of elongated compartments having a length between said closed end of said shell and said open end, each one of said compartments in said core assembly having a pair of open ends, said core assembly further including a pair of end plates for closing said open ends; and a lid connectable to said shell for closing said open end of said shell.

10. The container as claimed in claim 9, further comprising at least one pair of spacers sized and shaped for insertion into opposed ends of one of said plurality of compartments for reducing said length of said one compartment.

11. The container as claimed in claim 10, wherein one of said spacers is connected to one of said end plates and another one of said spacers is connected to another one of said end plates.

12. The container as claimed in claim 10, wherein said one compartment has a predetermined cross-section and each one of said spacers has a cross-section which is about the same as said predetermined cross-section so that said pair of spacers fit snugly within said opposed ends of said one compartment.

13. The container as claimed in claim 10, wherein said spacers include a material having high nuclear radiation shielding properties.

14. A container for storing hazardous materials, comprising a shell having a closed end, an open end, and an interior cavity extending in a longitudinal direction between said closed end and said open end;

a core assembly arranged in said shell, said core assembly including a plurality of wall members extending in said longitudinal direction to divide said interior cavity of said shell into a plurality of elongated compartments having a length between said closed end of said shell and said open end; and a lid connectable to said shell for closing said open end, said lid including a lower threaded portion and said shell including an interior threaded portion at said open end, whereby said lid is threadedly connectable to said shell.

15. The container as claimed in claim 1, further comprising a sealing element for providing a mechanical seal between said lid and said shell.

16. The container as claimed in claim 15, wherein said interior cavity of said shell includes a shoulder at a distance from said open end, said sealing element being positioned between said shoulder and a bottom surface of said lid when said lid is connected to said shell.

17. The container as claimed in claim 15, wherein said sealing element comprises a metallic disk.

18. The container as claimed in claim 1, further comprising a radiation shielding insert positioned to overlie selected walls in each one of said plurality of compartments.

19. The container as claimed in claim 18, wherein said radiation shielding insert is formed from a material selected from the group consisting of hafnium, borated aluminum, borated alloys including copper, borated stainless steels, and mixtures thereof.

20. The container as claimed in claim 18, wherein said selected walls are those walls separating one compartment from an adjacent compartment.

21. A container for storing hazardous materials, comprising a shell having a closed end, an open end, and an interior cavity extending in a longitudinal direction between said closed end and said open end;

a core assembly arranged in said shell, said core assembly including a plurality of wall members extending in said longitudinal direction to divide said interior cavity of said shell into a plurality of elongated compartments having a length between said closed end of said shell and said open end, said core assembly including a multiplicity of segments connected to one another, each said segment including plural ones of said compartments; and a lid connectable to said shell for closing said open end.

22. The container as claimed in claim 21, wherein said segments are identical to one another.

23. The container as claimed in claim 21, wherein each said segment includes an outer surface shaped for mating engagement with an interior surface of said shell, a pair of elongated peripheral edges disposed on opposite ends of said outer surface, and an elongated internal edge spaced from said outer surface, said segments being connected to one another at least along said pair of peripheral edges.

24. The container as claimed in claim 1, further comprising a plug of radiation shielding material connected to said lid, said plug having a cross-section substantially equal to a cross-section of said open end of said shell.

25. The container as claimed in claim 14, further comprising a sealing element for providing a mechanical seal between said lid and said shell.

26. The container as claimed in claim 25, wherein said sealing element comprises a metallic disk.

27. The container as claimed in claim 14, further comprising a plug of radiation shielding material connected to said lid, said plug having a cross-section substantially equal to a cross-section of said open end of said shell.

28. A container for storing hazardous materials, comprising a shell having a closed end, an open end, and an interior cavity extending in a longitudinal direction between said closed end and said open end;

a core assembly arranged in said shell, said core assembly including a plurality of wall members extending in said longitudinal direction to divide said interior cavity of said shell into a plurality of elongated compartments having a length between said closed end of said shell and said open end, said plurality of wall members defining substantially uninterrupted thermal paths extending outward radially from a center of said core assembly to said shell, said thermal paths extending along substantially the entirety of said length of said compartments; and a lid connectable to said shell for closing said open end.

29. The container as claimed in claim 28, wherein said interior cavity of said shell has an arcuate shape, said core assembly further comprising arcuate components adjacent said shell and conforming to said arcuate shape, said thermal path continuing substantially uninterrupted from said plurality of wall members to said arcuate components.

* * * * *

UNITED STATES PATENT AND TRADEMARK OFFICE

CERTIFICATE OF CORRECTION

PATENT NO. : 5,995,573

DATED : November 30, 1999

INVENTOR(S) : Murray, Jr.

It is certified that error appears in the above-identified patent and that said Letters Patent is hereby corrected as shown below:

Column 11, line 49, after "arranged" insert --in--.

Signed and Sealed this

Twenty-sixth Day of September, 2000

*Attest:*

Q. TODD DICKINSON

*Attesting Officer*

*Director of Patents and Trademarks*